United States Patent [19]

Spector

[11] Patent Number: 4,671,306

[45] Date of Patent: Jun. 9, 1987

[54] NAIL-POLISH-REMOVING THIMBLE

[76] Inventor: Donald Spector, 380 Mountain Rd., Union City, N.J. 07087

[21] Appl. No.: 436,400

[22] Filed: Oct. 25, 1982

[51] Int. Cl.[4] ..... A45D 29/00

[52] U.S. Cl. ..... 132/73

[58] Field of Search ..... 132/73; 401/122; 15/104.92, 210 R; 229/1.5 B, 1.5 R

[56] References Cited

U.S. PATENT DOCUMENTS

| | | | |
|---|---|---|---|
| Re. 25,618 | 7/1964 | Goodman | 229/1.5 B X |
| 2,961,682 | 11/1960 | Wurmböck et al. | 15/104.92 X |
| 3,369,553 | 2/1968 | Keesee | 15/210 R |
| 4,282,891 | 8/1981 | Duceppe | 401/122 |

*Primary Examiner*—Gregory E. McNeill
*Attorney, Agent, or Firm*—Michael Ebert

[57] ABSTRACT

A disposable nail polish-removing thimble capable of quickly dissolving and removing the enamel coating from the surface of a fingernail or toenail, the thimble having a sufficient capacity to remove the polish from a full set of an individual's nails. The thimble is constituted by a miniature plastic cup having a peel-off cover, the cup housing a flexible foam plastic sponge saturated with an enamel solvent. The sponge has a center slit therein into which one may insert a finger or toe, the thimble then being rotated relative to the inserted member to remove the nail polish.

5 Claims, 6 Drawing Figures

Fig. 1.
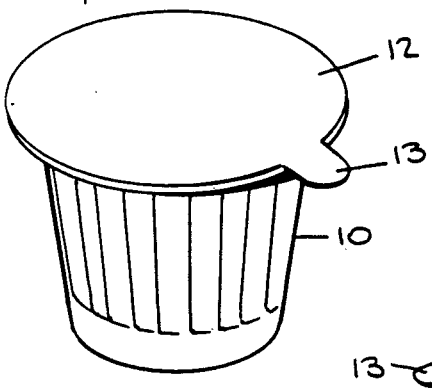
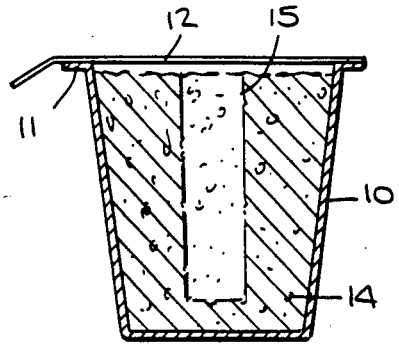
Fig. 2.
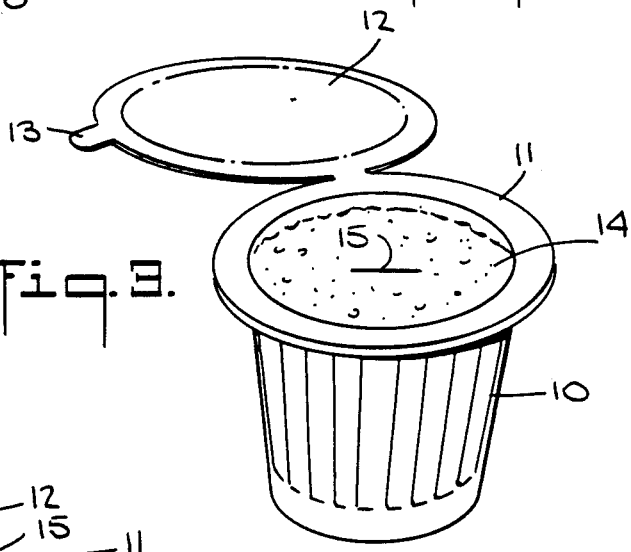
Fig. 3.
Fig. 4.
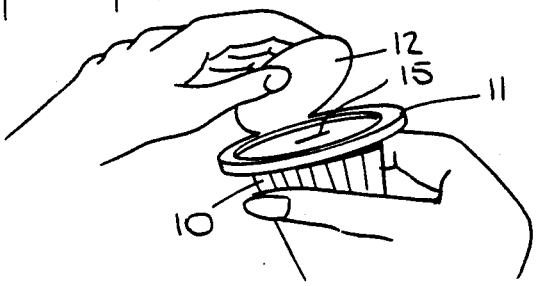
Fig. 5.
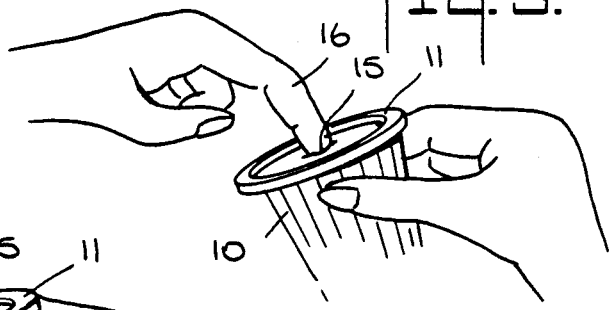
Fig. 6.
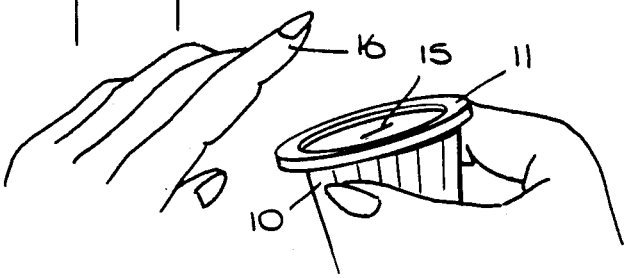

NAIL-POLISH-REMOVING THIMBLE

BACKGROUND OF INVENTION

This invention relates generally to techniques for removing nail polish from the fingernails or toenails, and more particularly to a disposable thimble capable of quickly dissolving and removing the enamel coating from the nail surfaces of a full set of fingers or toes.

A nail polish is a colored enamel coating applied to the nail surface of a finger or toe. Nail polishes are now in widespread use for cosmetic purposes. Since nail polishes have a relatively short life—for the enamel coating tends to chip off and otherwise become disfigured—it is the practice among women to remove the coating with an enamel solvent. Suitable for this purpose is acetone, a volatile, fragrant, flammable liquid ketone. The old coating, which in some instances may be multi-layered, must be fully removed before fresh polish can be applied.

Typically, nail polish removers are sold in bottles whose caps are provided with an applicator brush so that the user, by means of the brush, is able to apply the solvent to the nail surface to be cleaned. The user, when the polish is dissolved, must then use a tissue or other means to wipe off the dissolved polish from the nail surface. This is a somewhat complicated and messy operation. Moreover, the applicator brush becomes contaminated with the removed polish; and if returned to the bottle without first being cleaned, it contaminates the solvent therein.

In order to facilitate nail polish procedures, kits are now commercially available, such as the "Andrea—Swirl Off" kit marketed by Andrea Raab Corporation of Brooklyn, N.Y. This kit takes the form of a relatively large cylindrical container having a screw-on cap within which is a sponge saturated with an acetone solution. The sponge is provided with a central slit into which is inserted a dabber having a wire handle.

To use this kit for removing polish from fingernails, the dabber must first be taken out and set aside, the user inserting a finger in the slot which she then rotates relative to the container using circular up and down motion. The dabber which is also saturated with solvent is used when polish is to be removed from toenails or from the cuticle area.

The "Swirl Off" kit has a solvent capacity to work on hundreds of nails. But since the colored enamel removed from the nails necessarily remains in the sponge, the sponge becomes increasingly discolored thereby and becomes less effective with repeated use, so that the capacity is somewhat wasted and it is necessary to use a fresh kit before the solvent in the used kit is exhausted.

SUMMARY OF INVENTION

In view of the foregoing, the main object of this invention is to provide a disposable nail polish-removing thimble capable of removing the enamel coating from a full set of fingernails or toenails before being discarded.

More particularly, an object of this invention is to provide a nail polish-removing thimble which is easier to use and which acts more quickly than existing types of nail polish removers, for the user has only to insert the finger or toe in the thimble and rotate the thimble to dissolve and remove the polish, a procedure which is more easily carried out than one requiring rotation of the digital member.

Also an object of this invention is to provide a highly compact, inexpensive nail polish-removing thimble which is normally sealed by a peel-off cover to prevent the evaporation of the solvent therein, the thimble being activated simply by peeling off the cover.

Briefly stated, these objects are attained in a disposable nail polish-removing thimble capable of quickly dissolving and removing the enamel coating from the surface of a fingernail or toenail, the thimble having a sufficient capacity to remove the polish from a full set of an individual's nails. The thimble is constituted by a miniature plastic cup having a peel-off cover, the cup housing a flexible foam plastic sponge saturated with an enamel solvent. The sponge has a center slit therein into which one may insert a finger or toe, the thimble then being rotated relative to the inserted member to remove the nail polish.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a preferred embodiment of a thimble in accordance with the invention;

FIG. 2 is a section taken through the thimble;

FIG. 3 shows the cover removed from the cup to expose the saturated sponge therein;

FIG. 4 illustrates the first operating step;

FIG. 5 illustrates the second operating step; and

FIG. 6 illustrates the final step.

DESCRIPTION OF INVENTION

Referring now to FIGS. 1 and 2, there is shown a nail polish-removing thimble in accordance with the invention, the thimble including a small, slightly-tapered cup 10 molded of synthetic flexible plastic material, such as polyvinyl chloride or polypropylene. The cup is provided with an annular flange 11 surrounding its mouth. The cup which as a fluted side wall is sealed by a circular cover 12 whose diameter (about an inch and a half) matches the diameter of flange 11. The cover is bonded to the flange by a pressure-sensitive adhesive so that the cover, which is preferably made of an aluminum foil-plastic laminate, may be readily peeled off. A small extension tab 13 on cover 12 facilitates its removal from the cup.

The cup must be small enough to be grasped between the thumb and index finger of a user and to be rotated between these fingers. For this purpose, the cup and its cover may be of the type presently used commercially as individual miniature containers for cream to be added to a cup of coffee. Such containers are currently mass-produced at low cost and are sterile. Fitted nugly into cup 10 is a round, slightly tapered sponge 14, preferably formed of flexible foam plastic material such as polyurethane which is non-reactive with the solvent that impregnates the pores of the sponge.

The solvent which saturates the sponge is one suitable for dissolving any nail enamel and may, in practice, include acetone, water and fragrance, as well as a skin moisturizer. Sponge 14 is provided with a central slit 15 which extends almost the full depth of the sponge and is adapted to receive an inserted finger or toe of the user. Since the thimble is rotated relative to an inserted finger or toe, the fluting on the side of cup 10 serves to facilitate non-sliding engagement with the thumb and finger which grasp the cup and also to prevent the cup from sliding relative to the sponge housed therein. And because the cup wall is flexible, pressure exerted thereon by the fingers is transmitted to the sponge so that the sponge rotates with the cup despite the braking action of the inserted finger or toe.

As shown in FIG. 4, in order to put the thimble to use, the user first peels off cover 12 to expose the sponge 14. Until such time as the cover is removed, it acts to seal the contents and prevent evaporation of the solvent. Hence the thimble has an indefinite shelf life.

The user, as shown in FIG. 5, then inserts a finger 16 having a nail whose polish is to be removed into slit 15 to a degree sufficient to submerge the nail. The user then rotates the thimble held between his thumb and index finger and continues this swirling motion for a few seconds, in the course of which the enamel is dissolved by the solvent and the dissolved solvent is wiped off the surface of the nail by the sponge.

Then, as shown in FIG. 6, the cleansed finger 16 is removed and the operation is repeated for all other fingers of the hand, the thimble being then switched to the hand whose fingernails are now clean, so that the remaining five fingers can be cleaned. The cup has a sufficient solvent capacity for ten fingers, after which it is discarded. While the sponge picks up colored enamel, since it is only used for ten fingers, the solvent remains acceptably clean.

The same operation may be carried out on the toes of the foot, for the cup is small enough to fit between toes and to be rotated relative to the toe whose nail is being cleaned. In practice, a "Q-tip" or cotton swab may be used to remove polish from cuticles or other regions that the sponge is not able to reach, and for this purpose one has only to dip the Q-tip into the slit to saturate its swab with solvent. And because the thimbles are tiny, one may package a large number thereof in a single box to provide a user with a long-term supply.

While there has been shown and described a preferred embodiment of a nail-polish-removing thimble in accordance with the invention, it will be appreciated that many changes and modifications may be made therein without, however, departing from the essential spirit thereof. Thus, the cup may be made of aluminum rather than plastic material, and its shape may be in a polygonal form rather than round, to facilitate handling. And in practice, one may use a permanent cup for the thimble with replaceable sponge inserts.

I claim:

1. A nail polish-removing thimble usable to remove an enamel coating from finger and toenails, said thimble comprising:

A. a small cup which is graspable between the thumb and index finger of a user and rotated thereby, said cup having an annular flange which extends outwardly from its side wall, a removable cover which seals the contents thereof, said cover being of foil material which is bonded to the flange and is peelable therefrom; and B. a sponge nested in the cup and fully occupying its interior, said sponge being saturated with a solvent for said enamel coating, said sponge having a slit therein to receive the finger or toe whose nail is to be cleaned, which when inserted in the slit is subjected to pressure by the sponge, whereby the user may then rotate the cup relative to the inserted finger or toe to dissolve and wipe off the coating, said cup being formed of flexible material whose side wall has an outer surface facilitating non-sliding engagement with the thumb and index finger of the user who rotates the cup, pressure exerted on the flexible wall by the user being transmitted to the sponge so that the sponge rotates with the cup despite the braking action of the inserted finger or toe.

2. A thimble as set forth in claim 1, wherein said sponge is formed of foam-plastic material.

3. A thimble as set forth in claim 1, wherein said solvent is an acetone solution.

4. A thimble as set forth in claim 1, wherein said cup is molded of flexible plastic film material.

5. A thimble as set forth in claim 1, wherein said cup has a fluted side.

* * * * *